US011744000B2

(12) United States Patent
Li et al.

(10) Patent No.: US 11,744,000 B2
(45) Date of Patent: Aug. 29, 2023

(54) MECHANICAL SWITCH DIMMING AND SPEED REGULATION CONTROL SYSTEM

(71) Applicant: Huizhou Haomeishi Intelligent Technology Co., Ltd., Huizhou (CN)

(72) Inventors: Hui Li, Shenzhen (CN); Long Zhao, Shenzhen (CN)

(73) Assignee: HUIZHOU HAOMEISHI INTELLIGENT TECHNOLOGY CO., LTD., Huizhou (CN)

( * ) Notice: Subject to any disclaimer, the term of this patent is extended or adjusted under 35 U.S.C. 154(b) by 0 days.

(21) Appl. No.: 17/707,989

(22) Filed: Mar. 30, 2022

(65) Prior Publication Data

US 2022/0225489 A1 Jul. 14, 2022

Related U.S. Application Data

(63) Continuation of application No. PCT/CN2020/115208, filed on Sep. 15, 2020.

(51) Int. Cl.
*H05B 47/26* (2020.01)
*H05B 47/105* (2020.01)

(52) U.S. Cl.
CPC ..... *H05B 47/26* (2020.01); *H05B 47/105* (2020.01)

(58) Field of Classification Search
CPC .... H05B 47/26; H05B 47/105; H05B 47/185; H05B 45/31; H05B 39/044; H01H 9/541
See application file for complete search history.

(56) References Cited

U.S. PATENT DOCUMENTS 3,518,486 A * 6/1970 Babcock ..... H05B 41/40 315/196
4,695,739 A * 9/1987 Pierce ..... H05B 47/185 307/132 M (Continued)

FOREIGN PATENT DOCUMENTS

CN 103812490 A 5/2014
CN 109246904 A 1/2019

(Continued)

OTHER PUBLICATIONS

Written Opinion of the International Searching Authority for PCT/CN2020/115208, dated Sep. 15, 2019.

(Continued)

*Primary Examiner* — Daniel D Chang

(57) ABSTRACT

A mechanical switch dimming and speed regulation control system includes a double-contact mechanical switch including at least one alternating current live wire input end, and at least one group of normally closed contact and normally open contact mutually short-circuited with each other, a dimming and speed regulation controller including a signal collector and a dimming and speed regulation control circuit, and a controlled device, outputs of the normally closed and open contacts loop-connected with the dimming and speed regulation controller, the dimming and speed regulation controller loop-connected with the controlled device, the signal collector electrically connected with an output loop of the double-contact mechanical switch and the dimming and speed regulation control circuit, respectively; the dimming and speed regulation control circuit loop-connected with the controlled device. The present disclosure implements high-power dimming and speed regulation control of a single live wire by using the double-contact mechanical switch, and overcomes problems of power limitation of a conventional dimming and speed regulation (Continued)

switch and difficulty for an intelligent switch to implement dimming and speed regulation of the single live wire.

9 Claims, 5 Drawing Sheets

(56) References Cited

U.S. PATENT DOCUMENTS

| | | | | |
|---|---|---|---|---|
| 9,685,950 | B2 | 6/2017 | Xiao et al. | |
| 2011/0121752 | A1* | 5/2011 | Newman, Jr. ..... | H05B 39/048<br>315/291 |

FOREIGN PATENT DOCUMENTS

| | | | |
|---|---|---|---|
| CN | 110730544 | A | 1/2020 |
| CN | 210579392 | U | 5/2020 |

OTHER PUBLICATIONS

International Search Report for PCT/CN2020/115208, dated Sep. 15, 2019.

* cited by examiner

MECHANICAL SWITCH DIMMING AND SPEED REGULATION CONTROL SYSTEM

BACKGROUND

1. Technical Field

The present disclosure generally relates to the field of dimming and speed regulation control of lighting and motor products, and especially relates to a mechanical switch dimming and speed regulation control system.

2. Description of Related Art

At present, a wall dimming and speed regulation way of most lamps or fans adopts a direct output mode of using a thyristor to adjust light or using a segmentation speed regulation switch to adjust speeds mostly, however, due to volume limitation of the wall dimming and speed regulation switch, it is difficult to implement a dimming and speed regulation output with a high power, and a cost that adopts a wireless intelligent panel for performing dimming and speed regulation is high, so that it is also difficult to implement steady operation of a single live wire to supply power.

SUMMARY

The present disclosure implements high-power dimming and speed regulation control of a single live wire by using a double-contact mechanical switch, and overcomes problems of power limitation of a conventional dimming and speed regulation switch and difficulty for an intelligent switch to implement dimming and speed regulation of the single live wire, so as to implement reliable and stable local control of dimming and speed regulation, a simple operation and a lower cost.

The technical solution adopted for solving the above technical problems of the present disclosure is: a mechanical switch dimming and speed regulation control system includes a double-contact mechanical switch, a dimming and speed regulation controller and a controlled device. The double-contact mechanical switch includes at least one alternating current live wire input end, and at least one group of normally closed contact and normally open contact mutually short-circuited with each other. Outputs of the normally closed contact and the normally open contact are loop-connected with the dimming and speed regulation controller; and the dimming and speed regulation controller is loop-connected with the controlled device.

The dimming and speed regulation controller includes a signal collector and a dimming and speed regulation control circuit, the signal collector electrically connected with an output loop of the double-contact mechanical switch and the dimming and speed regulation control circuit, respectively, and the dimming and speed regulation control circuit loop-connected with the controlled device.

When the double-contact mechanical switch is switched from the normally closed contact to the normally open contact, all contacts are in a temporary suspension state, and at the moment, a first group of current output defect gaps are formed by an alternating current (AC) of a loop; on the contrary, when the double-contact mechanical switch returns to the normally closed contact from the normally open contact, all the contacts are in the temporary suspension state, and at the moment, an adjacent second group of current output defect gaps are formed by the alternating current (AC) of the loop; at this time, the signal collector of the light and speed regulation controller provides signals of two adjacent groups of current output defect gaps that have been detected to the dimming and speed regulation control circuit, and the dimming and speed regulation control circuit provides corresponding dimming and speed regulation control for the controlled device according to a different time of an interval period of the two groups of current output defect gaps.

Wherein the controlled device a lamp or a motor equipment.

Wherein a forward diode is connected between the alternating current live wire input end of the double-contact mechanical switch and the normally closed contact or the normally open contact, to implement forward dimming and speed regulation control related to the forward diode.

Wherein a negative diode is connected between the alternating current live wire input end of the double-contact mechanical switch and the normally closed contact or the normally open contact, to implement negative dimming and speed regulation control related to the negative diode.

Wherein the dimming and speed regulation control circuit provides on or off state reversal control for the controlled device when the period of the two adjacent groups of current output defect gaps is less than a certain fixed value.

Wherein the dimming and speed regulation control circuit includes a dimming and speed regulation circuit, and a processor electrically connected with the dimming and speed regulation circuit.

Wherein the dimming and speed regulation circuit is selected from a thyristor dimming and speed regulation circuit, a dimming and speed regulation circuit with a voltage of 0-10V, a PWM dimming and speed regulation circuit, a DALI dimming and speed regulation circuit and a switch-type control circuit.

Wherein the double-contact mechanical switch is composed of a mechanical switch with a pair of output contacts and an external short circuit wire between the pair of output contacts.

Wherein the double-contact mechanical switch can be a self-reset switch or a non-reset switch.

The present disclosure implements high-power dimming and speed regulation control of the single live wire by using the double-contact mechanical switch, and overcomes problems of power limitation of the conventional dimming and speed regulation switch and difficulty for an intelligent switch to implement dimming and speed regulation of the single live wire.

Figure 1:
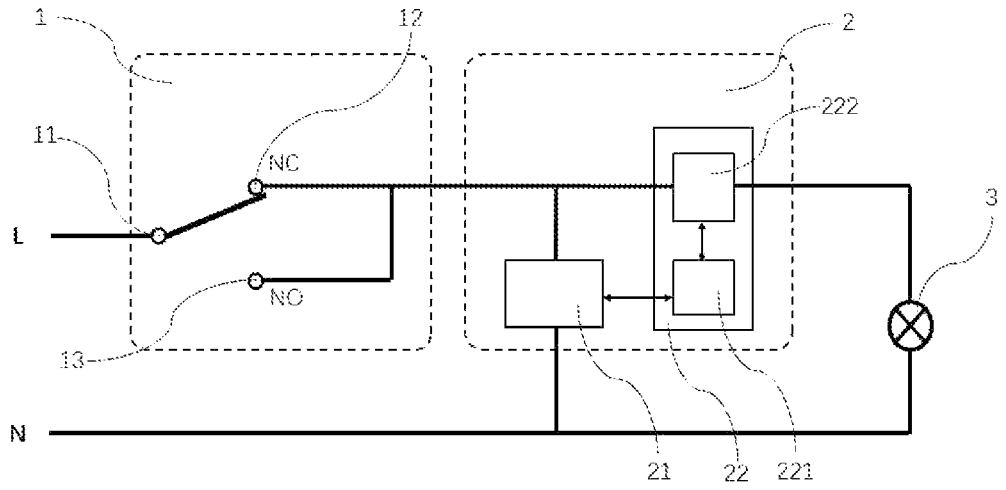
FIG. 1 is a schematic diagram of a normally closed state in accordance with the present disclosure.
Figure 2:
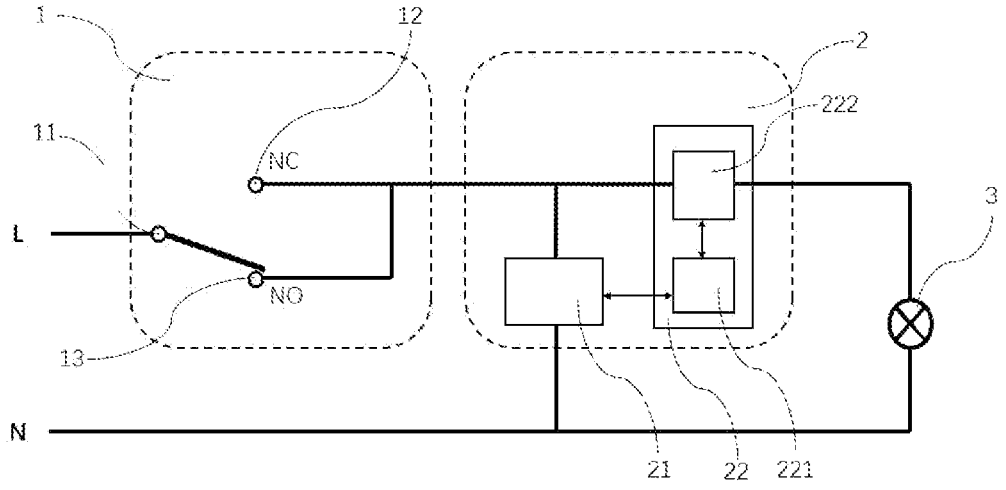
FIG. 2 is a schematic diagram of a normally open state in accordance with the present disclosure.
Figure 3:
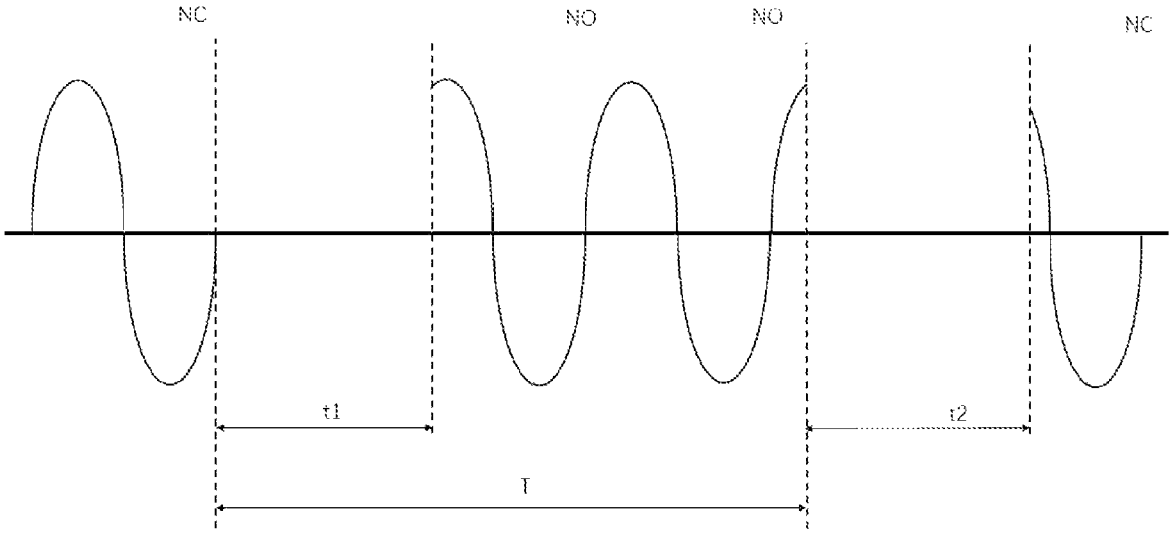
FIG. 3 is a waveform diagram of a current defect gap in accordance with the present disclosure.

The element labels according to the embodiment of the present disclosure shown as below:

double-contact mechanical switch 1, dimming and speed regulation controller 2, controlled device 3, alternating current live wire input end 11, normally closed contact 12, normally open contact 13, diode 14, signal collector 21, dimming and speed regulation control circuit 22, processor 221, dimming and speed regulation circuit 222

DETAILED DESCRIPTION

Unless otherwise defined, technical or scientific terms used herein shall have ordinary meanings as understood by one of ordinary skill in the art to which the present disclosure belongs. Terms "including", "includes", "comprises" or "comprising" and other similar words in the description and claims of the present disclosure mean that elements or items presented before the terms "including", "includes", "comprises" and "comprising" covers the element or item listed after the terms "including", "includes", "comprises" and "comprising" and their equivalents, and do not exclude other elements or items. The terms "connected" or "connection" and the like are not restricted to physical or mechanical connections, but can include electrical connections, whether direct or indirect.

Referring to FIGS. 1-3 and FIG. 8, a mechanical switch dimming and speed regulation control system includes a double-contact mechanical switch 1, a dimming and speed regulation controller 2 and a controlled device 3. The double-contact mechanical switch 1 includes an alternating current live wire input end 11 and at least one group of normally closed contact 12 and normally open contact 13 mutually short-circuited with each other, outputs of the normally closed contact 12 and the normally open contact 13 loop-connected with the dimming and speed regulation controller 2, and the dimming and speed regulation controller 2 loop-connected with the controlled device 3.

The dimming and speed regulation controller 2 includes a signal collector 21 and a dimming and speed regulation control circuit 22. The signal collector 21 is electrically connected with an output loop of the double-contact mechanical switch 2 and the dimming and speed regulation control circuit 22, respectively, and the dimming and speed regulation control circuit 22 is loop-connected with the controlled device 3.

When the double-contact mechanical switch 1 is switched from the normally closed contact 12 to the normally open contact 13, all contacts are in a temporary suspension state, and at the moment, a first group of current output defect gaps are formed by an alternating current (AC) of a loop, and a time is t1; on the contrary, when the double-contact mechanical switch 1 returns to the normally closed contact 12 from the normally open contact 13, all the contacts are in the temporary suspension state, and at the moment, an adjacent second group of current output defect gaps are formed by the alternating current (AC) of the loop, and a time is t2; at this time, the signal collector 21 of the light and speed regulation controller 2 provides signals t1, t2 of two adjacent groups of current output defect gaps that have been detected to a processor 221 of the dimming and speed regulation control circuit 22, and the processor 221 converts the signals of the two adjacent groups of current output defect gaps that have been detected into corresponding control instructions according to different times of an interval period of the signals of the two adjacent groups of detected current output defect gaps to the dimming and speed regulation circuit 222. If the interval period is less than a time T, output reversal state control, i.e., on or off, of the controlled device 3 is implemented through the dimming and speed regulation circuit 222; and if the interval period is greater than the time T, corresponding cyclic dimming and speed regulation control of the controlled device 3 is performed through the dimming and speed regulation circuit 222.

Figure 4:
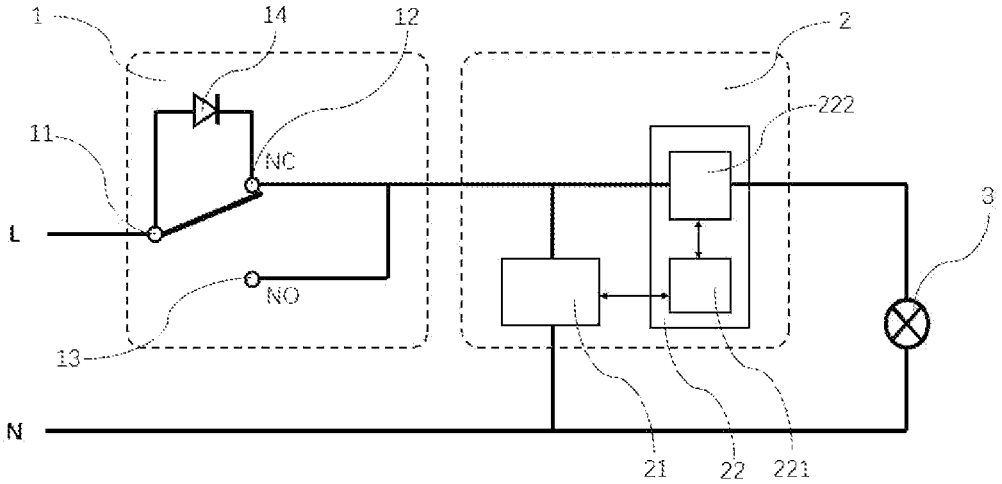
FIG. 4 is a schematic diagram of a forward regulation state in accordance with the present disclosure.
Figure 5:
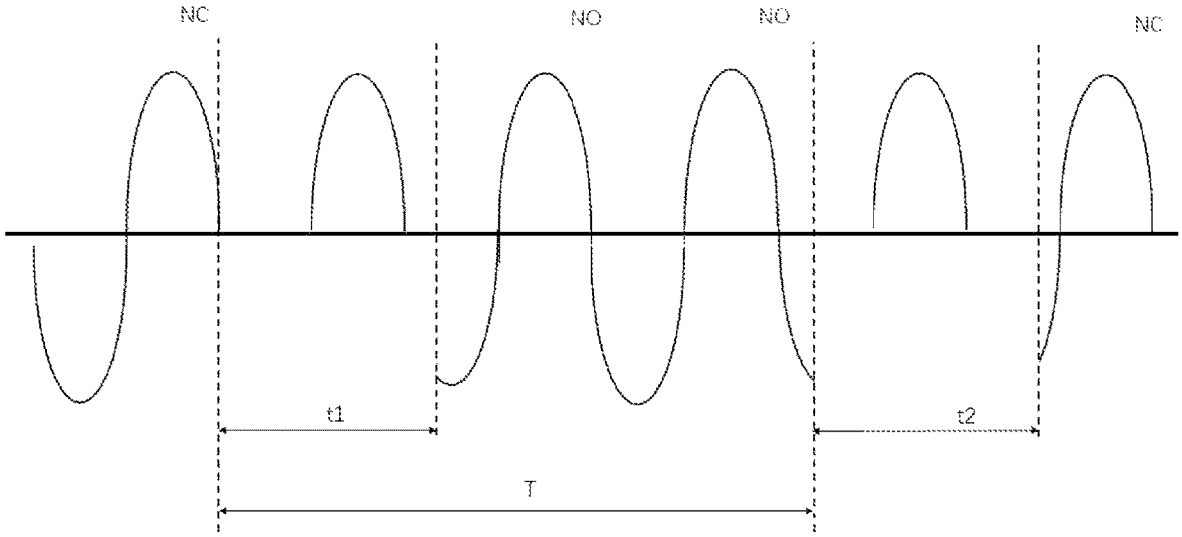
FIG. 5 is a waveform diagram of a forward regulation current defect gap in accordance with the present disclosure.
Figure 8:
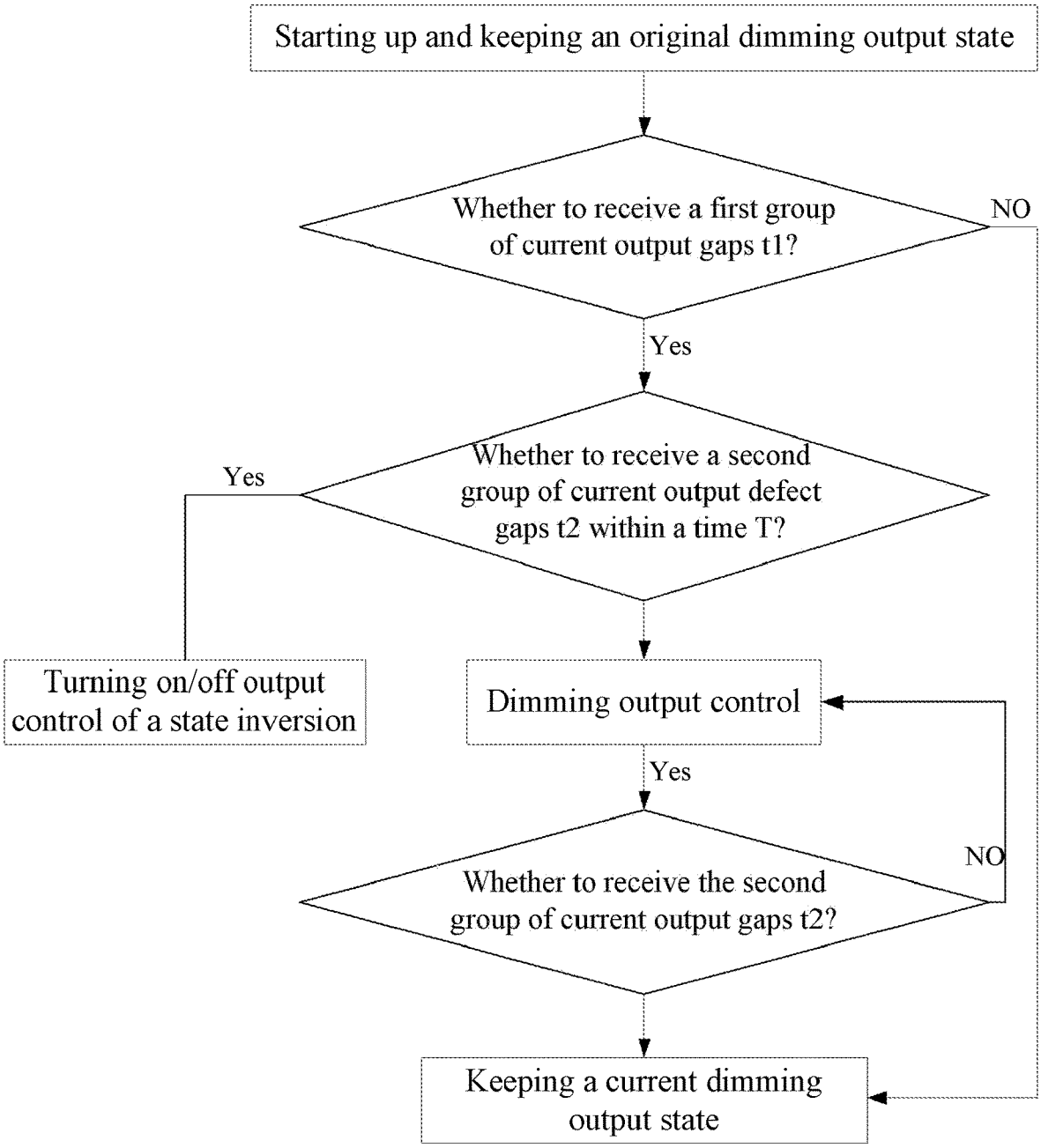
FIG. 8 is a flowchart of a processor in accordance with the present disclosure.

Referring to FIGS. 4-5 and FIG. 8, a forward diode 14 is connected between the live wire input end 11 of the double-contact mechanical switch 1 and the normally closed contact 12. When the double-contact mechanical switch 1 is switched from the normally closed contact 12 to the normally open contact 13, the double-contact mechanical switch 1 is in the temporary suspension state, and at the moment, the alternating current (AC) of the loop forms a first group of negative half-wave current output defect gaps through the forward diode 14, and the time is t1; on the contrary, when the double-contact mechanical switch 1 returns to the normally closed contact 12 from the normally open contact 13, the double-contact mechanical switch 1 is also in the temporary suspension state, and at the moment, the alternating current (AC) of the loop forms an adjacent second group of negative half-wave current output defect gaps through the forward diode 14, and the time is t2. The signal collector 21 of the dimming and speed regulation controller 2 provides signals t1, t2 of the above two adjacent groups of negative half-wave current output defect gaps that have been detected to the processor 221 of the dimming and speed regulation control circuit 22, and the processor 221 converts the signals t1, t2 of the two adjacent groups of negative half-wave current output defect gaps that have been detected into corresponding control instructions according to different times of the interval period of the signals of the two adjacent groups of negative half-wave current output defect gaps that have been detected, to the dimming and speed regulation circuit 222. If the interval period is less than the time T, output reversal state control, i.e., on or off, of the controlled device 3 is implemented through the dimming and speed regulation circuit 222; and if the interval period is greater than the time T, corresponding forward dimming and speed regulation control of the controlled device 3 is performed through the dimming and speed regulation circuit 222.

Figure 6:
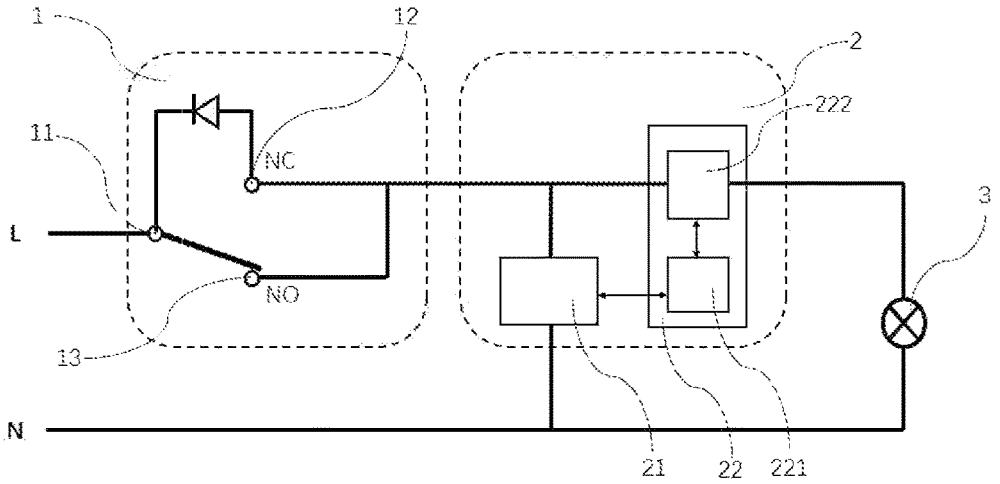
FIG. 6 is a schematic diagram of a negative regulation state in accordance with the present disclosure.
Figure 7:
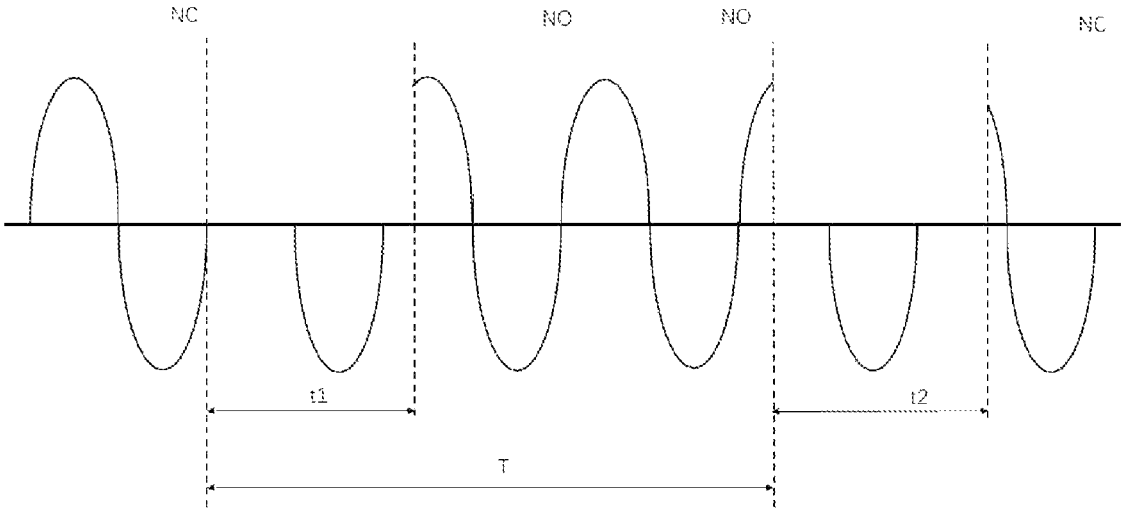
FIG. 7 is a waveform diagram of a negative regulation current defect gap in accordance with the present disclosure.

Referring to FIGS. 6-8, a negative diode 14 is connected between the live wire input end 11 of the double-contact mechanical switch 1 and the normally closed contact 12. When the double-contact mechanical switch 1 is switched from the normally closed contact 12 to the normally open contact 13, the double-contact mechanical switch 1 is in the temporary suspension state, and at the moment, the alternating current (AC) of the loop forms a first group of positive half-wave current output defect gaps through the negative diode 14, and the time is t1; on the contrary, when the double-contact mechanical switch 1 returns to the normally closed contact 12 from the normally open contact 13, the double-contact mechanical switch 1 is also in the temporary suspension state, and at the moment, the alternating current (AC) of the loop forms an adjacent second group of positive half-wave current output defect gaps through the negative diode 14, and the time is U. The signal collector 21 of the dimming and speed regulation controller 2 provides signals t1, t2 of the above two adjacent groups of positive half-wave current output defect gaps that have been detected, to the processor 221 of the dimming and speed regulation control circuit 22, and the processor 221 converts the signals t1, t2 of the two adjacent groups of positive half-wave current output defect gaps that have been detected into corresponding control instructions according to different times of the interval period of the signals of the two adjacent groups of positive half-wave current output defect gaps that have been detected, to the dimming and speed regulation circuit 222. If the interval period is less than the time T, output reversal state control, i.e., on or off, of the controlled device 3 is implemented through the dimming and speed regulation circuit 222; and if the interval period is greater than the time T, corresponding negative dimming and speed regulation control of the controlled device 3 is performed through the dimming and speed regulation circuit 222.

The above detailed description to the embodiment of the present disclosure is provided. Any variation or replacement made by one of ordinary skill in the related art without departing from the spirit of the present disclosure shall fall within the protection scope of the present disclosure.

What is claimed is:

1. A mechanical switch dimming and speed regulation control system comprising a double-contact mechanical switch, a dimming and speed regulation controller and a controlled device, the double-contact mechanical switch comprising at least one alternating current live wire input end, and at least one group of normally closed contact and normally open contact mutually short-circuited with each other, outputs of the normally closed contact and the normally open contact loop-connected with the dimming and speed regulation controller; and the dimming and speed regulation controller loop-connected with the controlled device;

the dimming and speed regulation controller comprising a signal collector and a dimming and speed regulation control circuit, the signal collector electrically connected with an output loop of the double-contact mechanical switch and the dimming and speed regulation control circuit, respectively, and the dimming and speed regulation control circuit loop-connected with the controlled device;

when the double-contact mechanical switch is switched from the normally closed contact to the normally open contact, all contacts are in a temporary suspension state, and at the moment, a first group of current output defect gaps are formed by an alternating current (AC) of a loop; on the contrary, when the double-contact mechanical switch returns to the normally closed contact from the normally open contact, all the contacts are in the temporary suspension state, and at the moment, an adjacent second group of current output defect gaps are formed by the alternating current (AC) of the loop; at this time, the signal collector of the dimming and speed regulation controller provides signals of two adjacent groups of current output defect gaps that have been detected to the dimming and speed regulation control circuit, and the dimming and speed regulation control circuit provides corresponding dimming and speed regulation control for the controlled device according to a different time of an interval period of the two groups of current output defect gaps.

2. The mechanical switch dimming and speed regulation control system as claimed in claim 1, wherein the controlled device is a lamp or a motor equipment.

3. The mechanical switch dimming and speed regulation control system as claimed in claim 2, wherein a forward diode is connected between the alternating current live wire input end of the double-contact mechanical switch and the normally closed contact or the normally open contact, to implement forward dimming and speed regulation control related to the forward diode.

4. The mechanical switch dimming and speed regulation control system as claimed in claim 2, wherein a negative diode is connected between the alternating current live wire input end of the double-contact mechanical switch and the normally closed contact or the normally open contact, to implement negative dimming and speed regulation control related to the negative diode.

5. The mechanical switch dimming and speed regulation control system as claimed in claim 1, wherein the dimming and speed regulation control circuit provides on or off state reversal control for the controlled device when the period of two adjacent groups of current output defect gaps is less than a certain fixed value.

6. The mechanical switch dimming and speed regulation control system as claimed in claim 5, wherein the dimming and speed regulation control circuit comprises a dimming and speed regulation circuit, and a processor electrically connected with the dimming and speed regulation circuit.

7. The mechanical switch dimming and speed regulation control system as claimed in claim 6, wherein the dimming and speed regulation circuit is selected from a thyristor dimming and speed regulation circuit, a dimming and speed regulation circuit with a voltage of 0-10V, a PWM dimming and speed regulation circuit, a DALI dimming and speed regulation circuit and a switch-type control circuit.

8. The mechanical switch dimming and speed regulation control system as claimed in claim 1, wherein the double-contact mechanical switch is composed of a mechanical switch with a pair of output contacts, and an external short circuit wire between the pair of output contacts.

9. The mechanical switch dimming and speed regulation control system as claimed in claim 8, wherein the double-contact mechanical switch is a self-reset switch.

* * * * *